US005084597A

United States Patent [19]

Lindsey et al.

[11] Patent Number: 5,084,597

[45] Date of Patent: Jan. 28, 1992

[54] DRUM SWITCH CONSTRUCTION

[75] Inventors: Kurt Lindsey, Milwaukee, Wis.; George Duda, West Chicago, Ill.

[73] Assignee: Furnas Electric Co., Batavia, Ill.

[21] Appl. No.: 608,333

[22] Filed: Nov. 2, 1990

[51] Int. Cl.[5] ..... H01H 19/56; H01H 21/76

[52] U.S. Cl. ..... 200/8 R; 200/24

[58] Field of Search ..... 200/8 R, 8 A, 24, 25, 200/26

[56] References Cited

U.S. PATENT DOCUMENTS

| | | | |
|---|---|---|---|
| 2,107,045 | 2/1938 | Rasmussen | 200/8 R |
| 2,108,883 | 2/1938 | Furnas et al. | 200/8 R |
| 2,137,481 | 11/1938 | Furnas et al. | 200/8 R |

*Primary Examiner*—Harold Broome

*Attorney, Agent, or Firm*—Wood, Phillips, Mason, Recktenwald & VanSanten

[57] ABSTRACT

An electrical switch including a frame defined by a base and two opposing end walls extending substantially perpendicular from the base, and a spindle journalled in the line holes in the end walls to allow for oscillatory movement of the spindle. A plurality of resilient stationary contacts arms are releasably secured to the base and are cooperable with the moveable contact. A cam having a plurality of concave recesses on its periphery is positioned on the spindle. A bearings surface is biased against the cam. The biasing is accomplished by a spring positioned in a housing mounted on the frame. There is also a handle connected to the spindle for rotating the spindle so that the bearing surface may engage the cam recesses to releasably lock the spindle in a plurality of positions, thus resulting in the stationary contacts arm and moveable contact being selectively maintained in different electrical connection relationships.

14 Claims, 4 Drawing Sheets

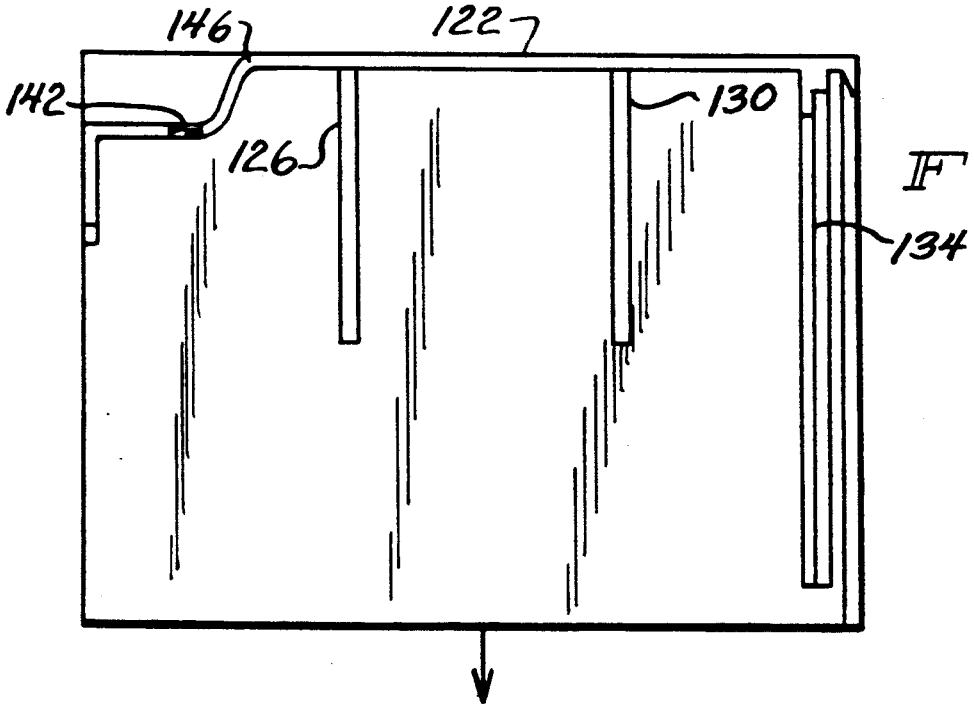
FIG. 2
FIG. 1
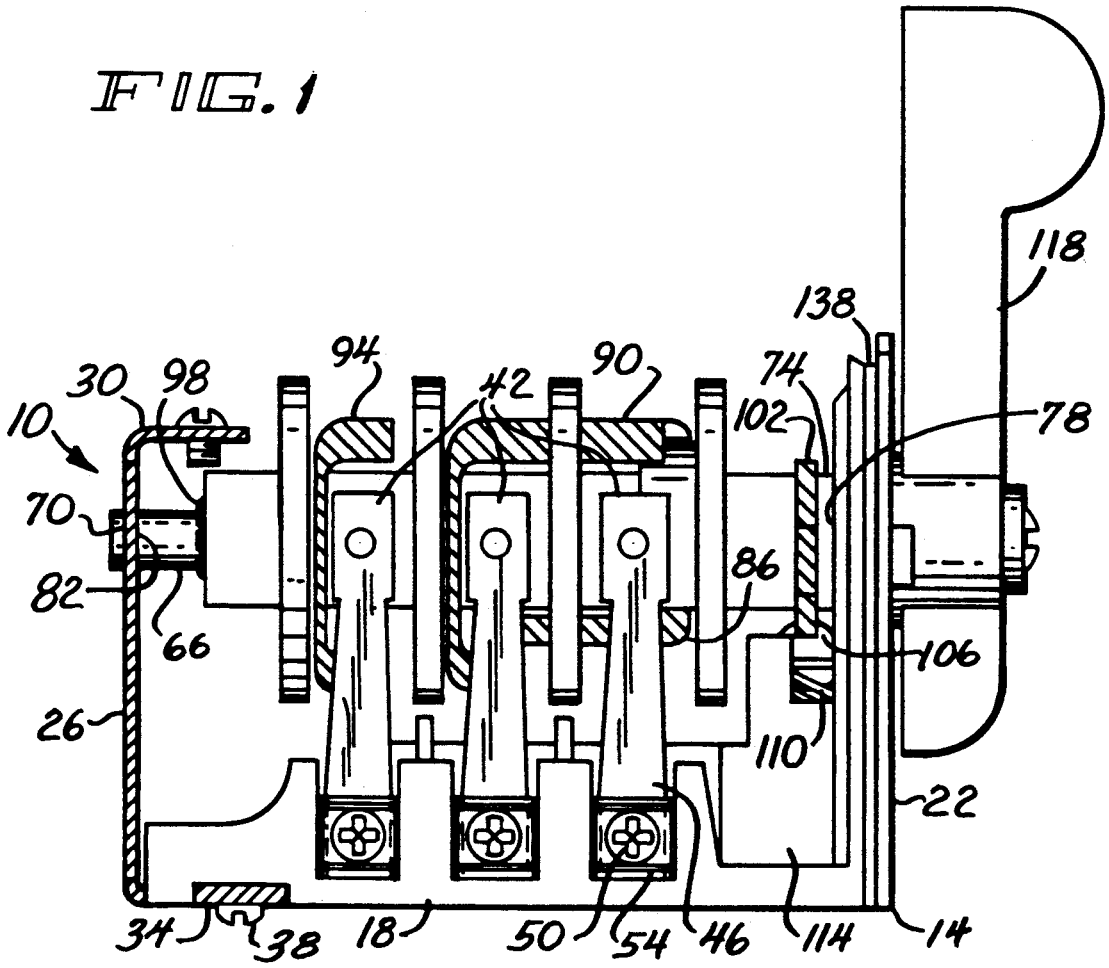

DRUM SWITCH CONSTRUCTION

FIELD OF THE INVENTION

This invention relates generally to improvements in the art of manufacturing electrical control mechanisms and more specifically to improvements in the construction and operation of a drum switch.

BACKGROUND OF THE INVENTION

Drum switches are used frequently as the electrical control switch in moist, messy and demanding places such as garages and filling stations. As such, it is desirable that the drum switch have a construction which allows convenient access to the switch for inspection and repair purposes.

It is also desirable to have these drum switch mechanisms durably constructed so as to require minimum attention and to resist excessive wear due to frequent operation.

Further, minimization of the cost of the production of such switch is desirable, and therefore a switch should have the least number of separate parts as possible to avoid excessive time for assembly.

Drum switches known in the art, such as those described in U.S. Pat. Nos. 2,108,883 and 2,137,481 (incorporated herein) provide drum switches which at least minimally meet the demands of such switches. However, a switch which can be improved in light of the above listed demands is desired.

SUMMARY OF THE INVENTION

An object of the present invention is to provide a new and improved electrical switch construction which is simple and compact in construction, highly efficient and durable.

Another object is to provide a new and improved electrical switch construction which is considerably less expensive and easier to manufacture than conventional switches.

The foregoing and other objects are realized by an electrical switch having a spindle with a plurality of moveable contacts thereon positioned in a frame such that the spindle may move in an oscillatory fashion when a handle, connected to the spindle, is moved. The switch further includes a plurality of resilient stationary contact arms which are cooperable with the moveable contacts on the spindle. The arms are releasably secured to the frame. A cam is positioned on the spindle and has a plurality of peripheral concave surfaces which interact with a detent biased against the cam. The biasing is accomplished by a spring positioned in a housing mounted on the frame. When the spindle is moved via the handle, the detent releasably locks the spindle in predetermined positions depending upon which peripheral concave surface of the cam is engaged by the detent.

Also encompassed by the invention is a switch much like that described above in which the stationary contact arms are releasably secured in supports integral with the base.

Another aspect of the invention includes a switch having an integral frame, housing and supports, thus reducing the number of different parts needed to be pieced together during manufacture.

Other objects and advantages will become apparent upon inspection of the drawings and the accompanying description of the preferred embodiment.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic illustration of a side view switch construction according to the invention with parts shown in section for clarity;

FIG. 2 is a cross-sectional view of the cover for covering the drum switch construction in FIG. 1;

DESCRIPTION OF THE PREFERRED EMBODIMENT

Figure 3:
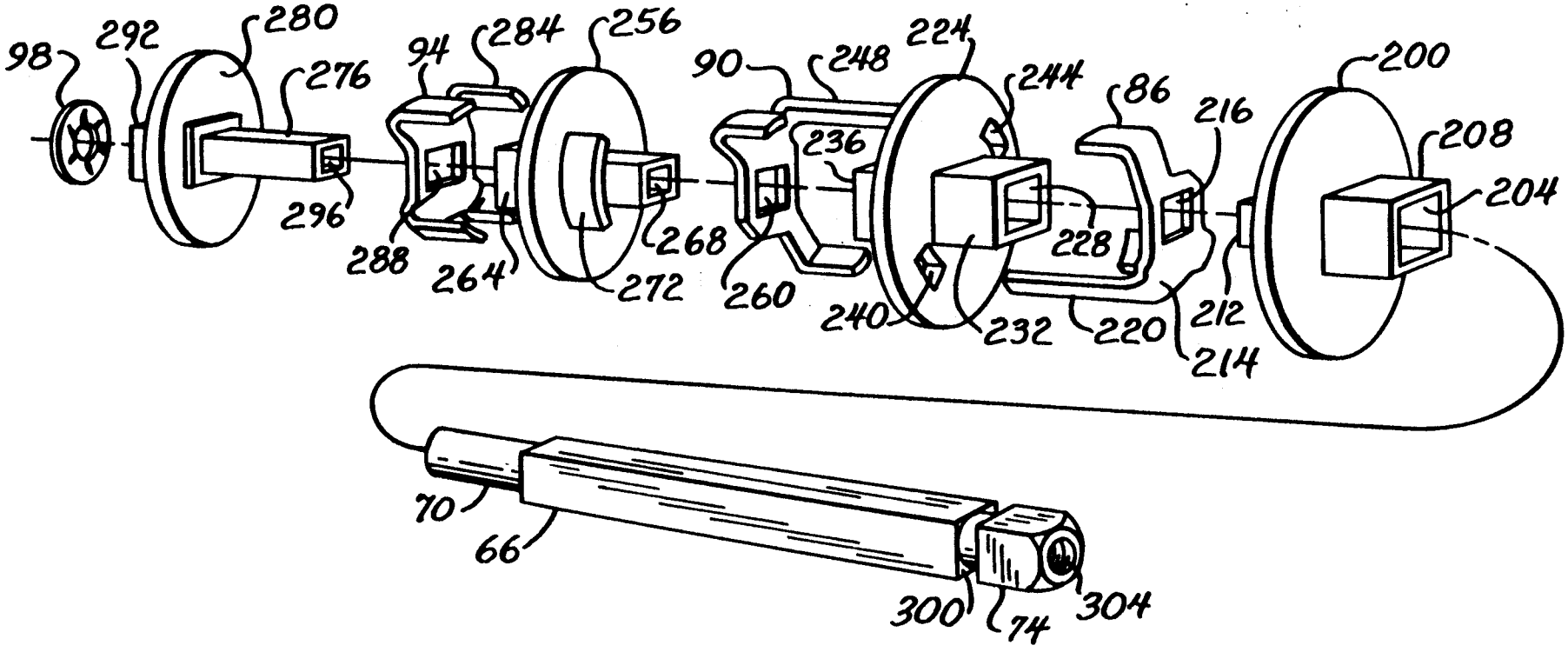
FIG. 3 is an exploded view of the movable contact portion of the drum switch according to the invention.

Referring now to the drawings, and specifically FIG. 1, shown is a drum switch, generally 10, which includes a frame 14 composed of a base 18 and a first end wall 22. The frame 14 is integral, that is, the first end wall 22 and the base 18 are of one piece construction. The material used in forming the frame 14 is preferably a nonconductive lightweight durable resin material, the resin material having characteristics favorable to resist wear.

Removably attached to the frame 14 at the opposite end of the base 18 from the first end wall 22 is a removable second end wall 26. The second end wall 26 is bent at its top and bottom to form a top surface 30 and a bottom surface 34 and is attached to the base 18 by screws 38 which extend through holes (not shown) in the second end wall 26 and the base 18. A more specific description of the second end wall 26 is provided later in the discussion of FIG. 7.

The drum switch 10 includes a first set 42 of three resilient, stationary contact arms 46 secured to the frame 14 by screws 50 and convex terminal pieces 54. There is also a second set 58 of three resilient stationary contact arms 62 opposite the first set 42 (shown in FIG. 5).

Returning to FIG. 1, the drum switch 10 includes an oscillatory contact carrying spindle 66 having a distal end 70 and a proximal end 74. The spindle 66 is journalled in the end walls 22, 26 through apertures 78, 82 (FIGS. 5, 7) respectively. The spindle 66 is positioned between the two sets 42, 58 of stationary contact arms 46, 62, and it provides support for numerous items including a series of movable contacts 86, 90, 94 (See also FIG. 3) which are cooperable with the two sets 42, 58 of stationary contact arms 46, 62. The moveable contacts 86, 90, 94 are formed of a conductive material, preferably copper. Near the distal end 70 of the spindle 66 is positioned a lock spring 98 which is used to retain the numerous items in their position on the spindle 66.

A cam 102 is supported by the spindle 66 near the spindle's proximal end 74. A sphere serves as a detent 106 and is biased against the cam 102 by a spring 110. The spring 110 is contained in a housing 114 which is integral with the frame 14. The spring 110 has one of its ends seated in the housing 114 and extends substantially parallel with the first end wall 22 and away from the base 18. The opposite end of the spring 110 mounts the detent 106 and urges it against the surface of the cam 102 so as to retain the movable contacts 86, 90, 94 in or out of contact with the two sets 42, 58 of stationary contact arms. The shape of the cam 102 is described in greater detail later herein in association with FIG. 3.

The drum switch 10 also includes a handle 118 formed preferably with a lightweight durable resin and, which is attached to the proximal end 74 of the spindle 66 for rotating the spindle 66 to various predetermined rotational positions.

Shown in FIG. 2 is a removable U-shaped cover 122 in cross-sectional view, and formed for cooperation with the frame 14 and the first 22 and second end walls 26. The cover 122 is preferably made of a non-conductive material and is desirably a light weight durable resin. The cover 122 includes strengthening ribs 126, 130 extending from the interior of opposing sides of the U-shaped cover 122. The cover 122 also has a raised internal ridge 134 which aligns with a channel 138 (FIG. 1) in the first end wall 22 in which the cover 122 may be slidably, removably positioned over the drum switch 10. The cover 126 also has a hole 142 through its top surface 146 through which a screw or the like may be inserted to removably attach the cover 122 to the second end wall top surface 30.

Turning now to FIG. 3, shown in more detail is the spindle 66 and the items which it supports. The first item is a first contact support and insulator 200 having a hole 204 therethrough, defined by a first raised area 208 and a rectangular key 212, for accepting the spindle 66. The next item supported by the spindle 66 is one of the three movable contacts 86, designated 214, also having a keyed hole therethrough 216 for accepting the key 212 to couple the contact 214 to the spindle for rotation therewith while electrically isolating the two. The contact 214 also includes an axially elongated contact tine 220.

Next, there is a second contact support and insulator 224 having a keyed hole 228 therethrough defined by a first raised area 232 and a rectangular key 236 for accepting the spindle 66. The second circular divider 224 also includes two other holes 240, 244 for accepting and supporting two tines 220, 248 of the first movable contact 86 and the second movable contact 90, respectively. The hole 228 is sized to also accept the rectangular key 212 of the first support and insulator 200 and also a rectangular key 252 on a third contact support and insulator 256. Thus, the second contact 90 is also keyed to the spindle 66 while being electrically isolated therefrom.

The second movable contact 90 has a keyed hole 260 for accepting the rectangular key 252 of the third circular divider 256. The movable contact 90 also has three tines 248, one of which is considerably axially elongated and extends through the hole 244.

The rectangular key 252 and a larger key 264 on the third contact support and insulator 256 include a square hole 268 for accepting the spindle 66. The third contact support and insulator 256 also includes an arcuate shield 272 to prevent arcing between the first 86 and second 90 movable contacts. The key 264 of the third contact support and insulator 256 is sized to accept a square key 276 on a fourth insulator 280.

Between the third and fourth insulators 256 and 280 is the last moveable contact 94 having four tines 284, and a hole 288 for accepting the key 276. This again couples the contact 94 to the spindle 66 while achieving electrical isolation.

Finally, there is the lock spring washer 98 which is positioned on the distal end 70 of the spindle 66 for retaining the previous mentioned items on the spindle 98.

The spindle 66 is generally square in cross section although the distal end 70 has a cylindrical shape. Further, the spindle 66 has a notched section 300 and a threaded hole 304 therethrough at its proximal end 74. The contact supports and insulators are made of a non-conductive material and preferably a lightweight durable resin.

When the discussed items in FIG. 3 are placed on the spindle 66, or in other words, the spindle 66 is inserted into the first circular divider's hole 204 thereafter through the various items' holes, and finally exiting the fourth circular divider's second raised area 292, the items will interfit or telescope to enclose the spindle 66 from the location where the lock washer 98 is positioned near the cylindrical distal end 70 of the spindle 66 toward the proximal end 74 of the spindle 66. The enclosure stops just short of the notched section 300 of the spindle 66.

Figure 4:
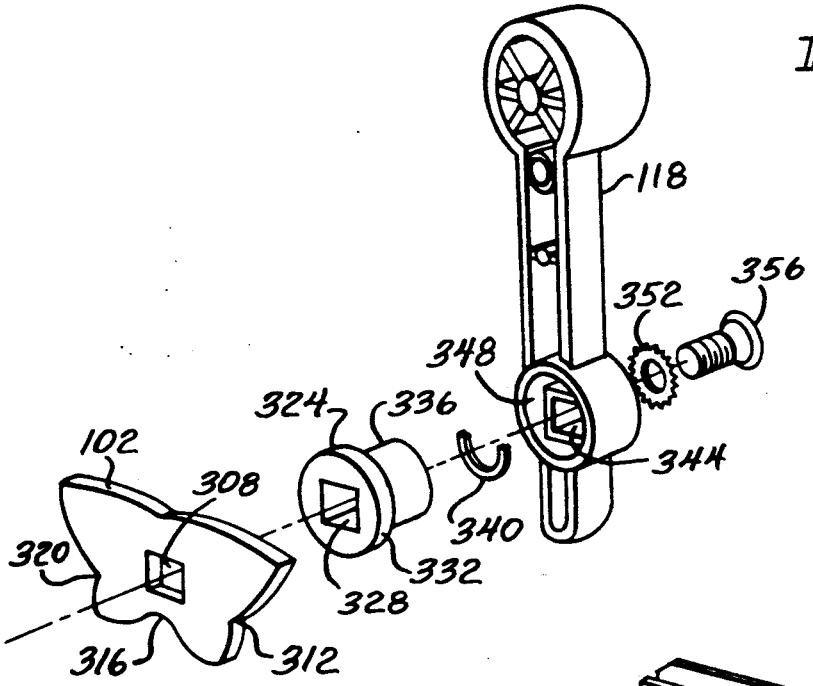
FIG. 4 is an exploded view of the locking member construction for the drum switch according to the invention.

Turning now to FIG. 4, shown are the items which are positioned adjacent the proximal end 74 of the spindle 66 on the side of the contact support and insulator 200 remote from the contacts. The first item is the cam 102 which has a keyed hole therethrough 308 for accepting the spindle 66. The cam 102 further has three concave recesses 312, 316 320 in its periphery which may receive the detent 106 to maintain the movable contacts 86, 90, 94 in three different relationships with the two sets of stationary contacts 42, 58. The cam 102 abuts the raised area 208 on the first contact support and insulator 200 (FIG. 3) when positioned on the spindle 66.

Figure 5:
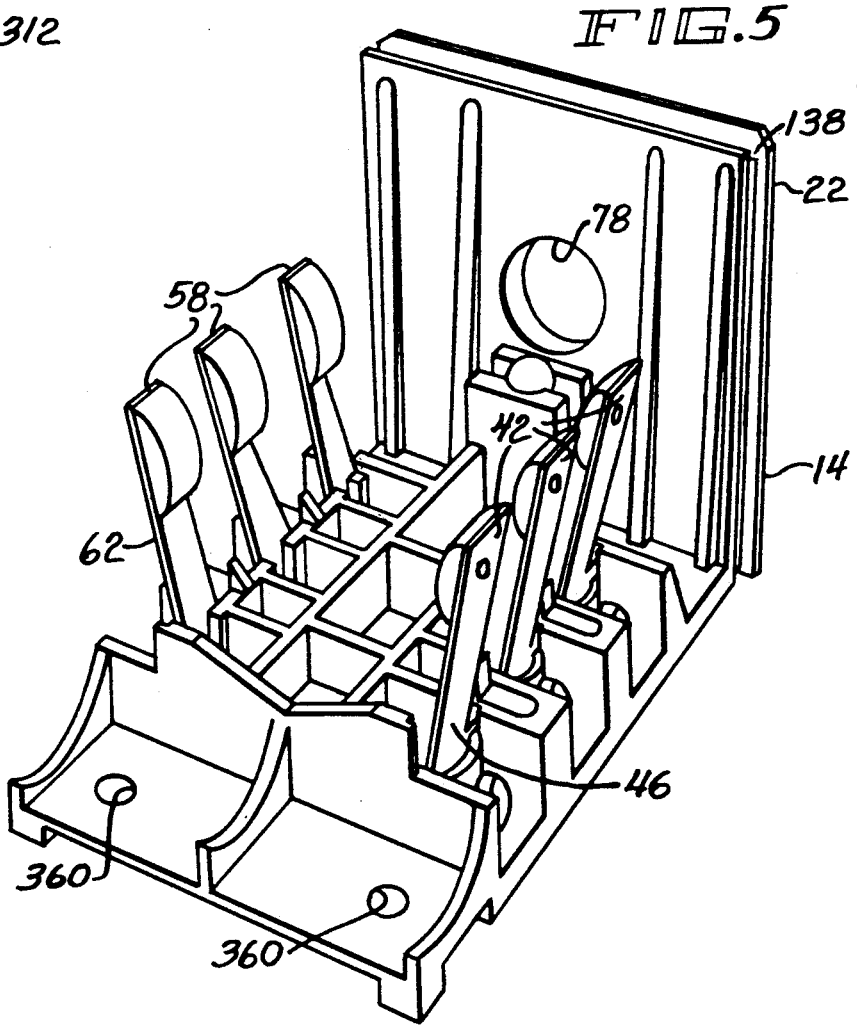
FIG. 5 is a perspective view of the base of the drum switch.

Thereafter is a collar 324 also having a hole 328 therethrough for accepting the proximal end 74 of the spindle 66. The collar 324 has a shoulder 332 which will butt-up against the cam 102 when the drum switch 10 is assembled. The shoulder 332 also serves as a journal for the spindle 66 when received in the opening 78 in the frame 22 (FIGS. 1 and 5). The collar terminates in a cylindrical section 336.

The next item is a C-shaped spring clip 340 sized to fit into the notched section 300 of the spindle 66 and acts to prevent axial movement of the items on the spindle 66.

The handle 118 has a hole 344 therethrough for accepting the spindle 66, and a recessed area 348 for accepting the cylindrical section 336 of the collar 324 and housing the clip 340. Finally, there is a lock washer 352 and a screw 356 for attaching the handle 118 to the spindle 66. The bolt 356 is threaded into the threaded hole 304 of the spindle 66 at its proximal end 74.

Turning now to FIG. 5, shown is the frame 14 along with the two sets 42, 58 of stationary contact arms 46, 62. Also shown is the channel 138 in which the raised area 134 of the cover 122 (FIG. 1) can be releasably slidably positioned. Also shown more clearly is the hole 78 in the first end wall 22 through which the spindle 66, surrounded by the shoulder 332 on the collar 324, is journalled. Additionally shown are holes 360 which receive the screws 38 to releasably connect the second end wall 26 to the frame 14.

Figure 6:
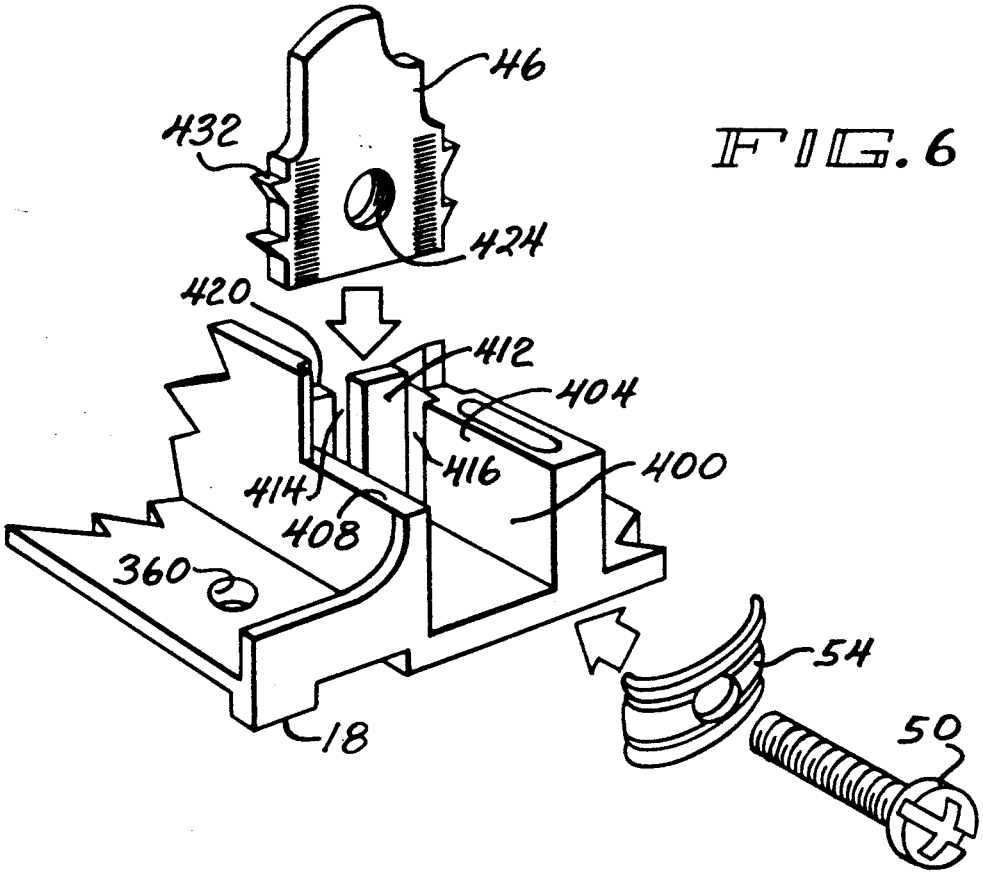
FIG. 6 exploded view of the stationary contact attachment in the drum switch according to the invention.

FIG. 6 shows a preferred means of attachment of a stationary contact arm 46 with the base 18. The base 18 has an integral stationary contact arm support pocket 400 defined by two opposing side walls 404, 408 and a back wall 412 having a slot 414. Two side channels 416, 420 adjacent the back wall 412 are sized to accept the stationary contact arm 46 which may readily be installed as part of a subassembly made up of a screw 50 impaling a terminal piece 54 and partially threaded in a threaded hole 424 in the stationary contact arm 46. The slot 414 of the back wall 412 provides clearance for the screw 50 as the stationary contact arm 46 is inserted into the base 18. The stationary contact arm 46 further has barbs 432 extending from the side thereof that lodge in the softer resin of which the base 18 is formed to retard movement of the stationary contact arm 46 from the side channels 416, 420.

Figure 7:
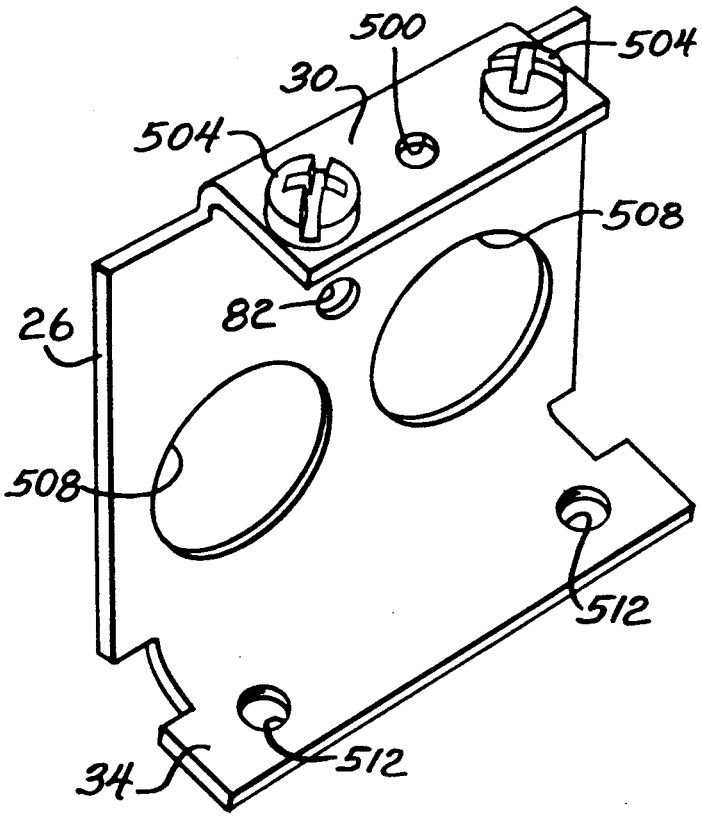
FIG. 7 is a perspective view of the removable end wall of the drum switch according to the invention.

As shown in FIG. 7, the second end wall 26 has a hole 500 which corresponds to the hole 142 of the cover 122 (FIG. 1) through which a bolt or screw may be extended to attach the cover 122 to the second end wall 26. Also provided are two screws 504 on the top section 30 of the second end wall 26 for securing ground wires (not shown). The second end wall 26 includes the hole 82 for journalling the distal end 70 of the spindle 66, and two holes 508 through which electrical wire (not shown) can pass to attach to the drum switch 10 between the contact arms 46, 62 and washers 54. Lastly, the second end wall 26 has threaded holes 512 in the bottom surface 34. The threaded holes 512 permit entry of screws 38 (FIG. 1) which will extend into the holes 360 (FIG. 5) in the base 18 which are aligned therewith to maintain the second end wall 26 in attachment with the base 18.

The particular construction of the drum switch 10 permits easier and quicker assembly, lower total switch costs, and a lighter weight switch. These are in part due to the reduced number of parts involved, the interfitting of the items carried on the spindle 66, and the integral frame 14. The cam 102 and bearing surface 106 relationship provides a more durable, simpler means for moving the stationary contact arms 44, 62 the moveable contacts 86, 90, 94 into and out of contact.

We claim:

1. An electrical switch comprising:

a frame having a base and a first end wall extending substantially perpendicularly from a first base end, said first end wall having an inner side and an outer side;

a second end wall extending substantially perpendicularly from a second base end, said second end wall substantially parallel with said first end wall, said second wall having an inner side facing said first end wall inner side, and an outer side;

a spindle having distal and proximal ends and a plurality of moveable contacts thereon, said spindle positioned between said first end wall inner side and said second end wall inner side, said spindle ends journalled for oscillatory movement in aligned holes in said first and second end walls;

a plurality of resilient stationary contact arms cooperable with said moveable contacts and releasably secured to said base;

a cam positioned on said spindle adjacent said spindle proximal end and adjacent said first end wall inner side, said cam having a plurality of peripheral concave surfaces;

a spring positioned in a housing, said housing mounted on said frame and adjacent said first end wall inner side, said spring biasing a bearing surface against said cam;

a handle adjacent said first end wall outer side and connected to said spindle proximal end for rotating said spindle so that said bearing surface may engage said cam concave peripheral surfaces to releasably lock said spindle in a plurality of positions.

2. The switch as recited as in claim 1 wherein said base and said first end wall are of an integral, one piece structure.

3. The switch as recited in claim 1 wherein said housing, said base and said first wall are of an integral, one piece structure.

4. The switch as recited in claim 3 wherein said base includes integral supports to which said stationary contact arms are releasably secured.

5. The switch as recited in claim 4 wherein said frame, housing and supports are comprised of a nonconductive lightweight durable resin.

6. The switch as recited in claim 1 wherein said first end wall includes a channel about its periphery, said second end wall being bent at an end most distant from said base to form a top surface, said top surface having a threaded hole therethrough, and further comprising a removable U-shaped cover having a raised internal ridge corresponding to said channel and a hole corresponding to said top surface hole, said U-shaped cover removably attached to said first end wall by engagement of said ridge with said channel and a single means for connecting inserted through said U-shaped cover hole and said top surface hole.

7. An electrical switch comprising:

a frame having a base and a first end wall extending substantially perpendicularly from a fist base end, said first end wall having an inner side and outer side;

a second end wall extending substantially perpendicularly from a second base end, said second end wall substantially parallel with said first end wall, said second end wall having an inner side facing said first end wall inner side, and outer side;

a contact carrying spindle having distal and proximal ends, said spindle positioned between said first end wall inner side and said second end wall inner side, said spindle ends journaled in aligned holes in said first and second end walls to allow oscillatory movement;

a plurality of resilient stationary contact arms cooperable with said contacts positioned on said spindle and releasably secured in integral supports integral with said base, said integral supports comprising preformed slots defined by two opposing side walls and a back wall connecting said side walls, said slots sized to accept stationary contact arm ends;

a cam positioned on said spindle and having a plurality of peripheral concave surfaces;

a detent;

means for biasing said detent against said cam and mounted on said frame; and a handle connected to said spindle for rotating said spindle such that said detent may engage said cam concave peripheral surfaces to releasably lock said spindle into a plurality of positions.

8. The switch as recited in claim 7 wherein said stationary contact arms have threaded holes therethrough adjacent their ends, said back wall having a slot, and further including threaded bolts positioned through a hole in a washer and thereafter threaded through said stationary contact arm threaded holes and said back wall slot to releasably secure said stationary contact arms to said base.

9. An electrical switch comprising;

a frame having a base and a first end wall extending substantially perpendicularly from a first base end, said first end wall having an inner side and outer side;

a second end wall extending substantially perpendicuarly from a second base end, said second end wall substantially parallel with said first end wall, said second end wall having an inner side facing said first end wall inner side, and outer side;

a contact carrying spindle having distal and proximal ends, said spindle positioned between said first end wall inner side and said second end wall inner side, said spindle ends journaled in aligned holes in said first and second end walls to allow oscillatory movement;

a plurality of resilient stationary contact arms cooperable with said contacts positioned on said spindle and releasably secured in integral supports integral with said base;

a cam positioned on said spindle and having a plurality of peripheral concave surfaces;

a detent;

means for biasing said detent against said cam and mounted on said frame; and a handle connected to said spindle for rotating said spindle such that said detent may engage said cam concave peripheral surfaces to releasably lock said spindle into a plurality of positions;

said first end wall including a channel about its periphery, said second end wall being bent at an end most distant from said base to form a top surface, said top surface having a threaded hole therethrough, and further comprising a removable U-shaped cover having a raised internal ridge corresponding to said channel and a hole corresponding to said top surface hole, said U-shaped cover removably attached to said first end wall by engagement of said ridge with said channel and a single means for connecting inserted through said U-shaped cover hole and said top surface hole.

10. The switch as recited in claim 9 wherein said frame, housing, cover and supports are all comprised of nonconductive lightweight durable resins.

11. An electrical switch comprising;

an integral frame having a base and a first end wall extending substantially perpendicularly from a first base end, said first end wall having an inner side and an outer side;

a second end wall removably attached adjacent to a second base end, said second end wall substantially parallel with said first end wall, said second end wall having an inner side and an outer side;

a spindle having distal and proximal ends and a plurality of interfitting moveable contacts and contact supports and insulators thereon, said spindle positioned between said first end wall inner side and said second end wall inner side, said spindle ends journalled in aligned holes in said first and second end walls for allowing oscillatory movement of said spindle;

a plurality of resilient stationary contact arms cooperable with said moveable contacts and releasably secured to integral supports of said base, a cam positioned on said spindle adjacent said spindle proximal end and adjacent said first end wall inner side, said cam having a plurality of peripheral concave surfaces;

a spring positioned in a housing, said housing integral with said frame and adjacent said first end wall inner side, said spring biasing a bearing surface against said cam;

a handle positioned adjacent said first end wall outer side and connected to said spindle proximal end for rotating said spindle such that said bearing surface may engage said cam concave peripheral surfaces to releasably lock said spindle into a plurality of positions.

12. The switch as recited in claim 11 wherein said first end wall includes a channel about its periphery, said second end wall being bent at an end most distant from said base to form a top surface, said top surface having a threaded hole therethrough, and further comprising a removable U-shaped cover having a raised internal ridge corresponding to said channel and a hole corresponding to said top surface hole, said U-shaped cover removably attached to said first end wall by engagement of said ridge with said channel and a single means for connecting inserted through said U-shaped cover hole and said top surface hole.

13. The electrical switch as recited in claim 11 wherein said cover, housing supports, and frame are comprised of nonconductive lightweight durable resins.

14. The electrical switch as recited in claim 11 wherein said spindle has a non-circular keyed surface and said contact supports and insulators include axially directed, keyed interfitting holes in telescoping relation on said spindle to couple said contact supports and insulators to said spindle while providing electrical isolation.

* * * * *